US006451393B1

(12) United States Patent
Ploetz

(10) Patent No.: US 6,451,393 B1
(45) Date of Patent: Sep. 17, 2002

(54) TURKEY BEARD DISPLAY DEVICE

(76) Inventor: Kevin R. Ploetz, 13953 Dupont Rd., Collins, NY (US) 14034

( * ) Notice: Subject to any disclaimer, the term of this patent is extended or adjusted under 35 U.S.C. 154(b) by 0 days.

(21) Appl. No.: 09/593,237

(22) Filed: Jun. 14, 2000

Related U.S. Application Data

(60) Provisional application No. 60/139,271, filed on Jun. 15, 1999.

(51) Int. Cl.[7] ..... B44C 5/00

(52) U.S. Cl. ..... 428/34.1; 428/99; 428/100; 434/296; 224/103

(58) Field of Search ..... 428/99, 100, 34.1; 224/103; 434/296

(56) References Cited

U.S. PATENT DOCUMENTS

| | | | | |
|---|---|---|---|---|
| D31,861 | S | 11/1899 | Copeland | |
| 1,082,516 | A | 12/1913 | Griffith | |
| 3,283,383 | A | 11/1966 | Heath | 24/245 |
| 3,300,173 | A | 1/1967 | Kennedy, Jr. | 248/467 |
| 3,533,890 | A | 10/1970 | Nesbit | 161/16 |
| 4,464,440 | A | 8/1984 | Dotzman | 428/542.4 |
| 4,717,626 | A | 1/1988 | Badger | 428/542.4 |
| 4,753,024 | A | 6/1988 | Rinehart | 40/160 |
| 4,944,081 | A | 7/1990 | Ross | 29/235 |
| 5,015,532 | A | 5/1991 | Knight | 428/542.4 |
| 5,064,725 | A | 11/1991 | Acker | 428/542.4 |
| 5,437,935 | A | 8/1995 | Fredeen | 428/542.4 |
| 5,472,765 | A | 12/1995 | Green | 428/99 |

FOREIGN PATENT DOCUMENTS

| | | |
|---|---|---|
| FR | 1158713 | 6/1958 |

*Primary Examiner*—Alexander S. Thomas
(74) *Attorney, Agent, or Firm*—Hodgson Russ LLP

(57) ABSTRACT

A turkey beard display device including a beard retainer and a casing. The beard retainer is a shaft having a ring or other fixture at one end of the shaft adapted for receiving a hook, and a pointed tip end having an engaging member at the other end of the shaft. The shaft has a radial flange extending transverse to the longitudinal axis of the shaft between the fixture and the shaft. One form of the casing includes the brass or brass plated hull of a shotgun shell, the shot, powder and primer having been removed. A method of mounting a turkey beard on the display device includes the steps of removing the beard from the turkey carcass including a fleshy plug, treating the fleshy plug in a preservative, placing the fleshy plug into the casing, inserting the barbed tip end through the primer pocket hole in the casing and impaling the barb in the fleshy plug, seating the flange in the hole, and drying the beard.

11 Claims, 3 Drawing Sheets

TURKEY BEARD DISPLAY DEVICE

CROSS-REFERENCE TO RELATED APPLICATION

Applicant hereby claims priority based on U.S. Provisional Application No. 60/139,271 filed Jun. 15, 1999, entitled "Turkey Beard Display Device", which is incorporated herein by reference.

FIELD OF THE INVENTION

The present invention relates to hunting trophies and display devices, and particularly to a display device for turkey beards.

BACKGROUND OF THE INVENTION

In the sport of game hunting, the preservation and mounting for display of a part of the animal's carcass is a time honored tradition. A highly prized trophy in wild turkey hunting is the turkey beard, which, together with the fan of turkey tail feathers and spurs from the turkey's legs, provide a remembrance of the hunt. The turkey beard is a growth of modified feathers approximately eight to ten inches long on the chest of the male turkey. The length and fullness of the turkey beard are thought to be related to the. turkey's virility, strength, age, and survival skills in an often hostile environment.

It is well known in the art of taxidermy to preserve and stuff small birds. However, the size of the turkey carcass results in a trophy whose size is too bulky and inconvenient for display and storage by the average hunter. Current methods and devices for displaying trophies from a successful turkey hunt devote scant attention to the turkey's beard, usually securing the beard to a plaque, mounting the fan of tail feathers, more or less as an afterthought. The present invention solves the problem of an appropriate display device for a turkey beard by providing a casing and ring for the turkey beard, furnishing the turkey beard with a decorative mount which may be attached to a hook in any desired location.

Prior methods of mounting a turkey beard for display are shown in U.S. Pat. No. 5,064,725, issued Nov. 12, 1991, to T. H. Acker; and U.S. Pat. No. 5,437,935, issued Aug. 1, 1995, to V. W. Fredeen. The Acker patent describes a plaque on which the tail fan, the legs, and the beard are mounted. After being salted, dried, and cured, the turkey beard is mounted to a recess in the plaque by a compressive fit of the butt, or by a "spot" of adhesive. The Fredeen patent describes a mounting block for bird feathers with holes for receiving the feathers. The Fredeen patent mentions mounting the turkey beard to a notch on the underside of the mounting block by adhesive.

Various devices and methods for mounting other animal trophies are shown in U.S. Pat. No. 4,464,440, issued Aug. 7, 1984, to J. G. Dotzman (mount for horned animal with simulated skull for receiving horns); U.S. Pat. No. 4,717,626, issued Jan. 5, 1988, to G. W. Badger (trophy mount for animal with antlers having improved bridge between the antlers); U.S. Pat. No. 4,753,024, issued Jun. 28, 1988, to J. R. Rinehart (animal foot formed into hook and mounted on plaque to form gun rack); U.S. Pat. No. 5,015,532, issued May 14, 1991, to T. E. Knight (taxidermy mount for animal head using plastic manikin); and U.S. Pat. No. 5,472,765, issued Dec. 5, 1995, to L. E. Green (kit for mounting antlers on a replica of a deer skull using dowels).

The present invention attaches a ring to the turkey beard using a shaft having a pointed tip end with barbs. Devices showing some features in common with or similar to the device of the present invention include: U.S. Des. Pat. No. 31,861, issued Nov. 21, 1899 (split ring on a threaded shaft); U.S. Pat. No. 1,082,516, issued Dec. 30, 1913, to N. S. Griffith (tool for removing seeds from fruit having loop mounted on shaft with pointed tip end having barbs); U.S. Pat. No. 3,283,383, issued Nov. 8, 1966, to R. J. Heath (device for securing ropes to sheets having ring mounted on shaft having a circular or conical knob at the other end); U.S. Pat. No. 3,533,890, issued Oct. 13, 1970, to J. R. Nesbit (hanger for Christmas ornament, being a shank with an eye at one end and pointed conical tip at the other end); U.S. Pat. No. 4,944,081, issued Jul. 31, 1990, to M. S. Ross (packing removal tool comprising hollow shaft with an eye and having spring biased plunger with pointed tip end and pivotally mounted barbs); and French Patent No. 1,158,713, published Jun. 18, 1958 (Christmas ornament hanger having an eye on a shaft pressed into body of the ornament).

None of the above inventions and patents, taken either singly or in combination, is seen to describe the instant invention as claimed.

SUMMARY OF THE INVENTION

The turkey beard display device includes a beard retainer and a casing. The beard retainer is a shaft having a ring or other fitting at one end of the shaft adapted for receiving a hook, and a pointed tip end having a barb or other engaging member at the other end of the shaft. The shaft has a radial flange extending transverse to the longitudinal axis of the shaft between the fitting and the shaft. The casing is the brass or brass plated hull of a shotgun shell, the plastic portion of the cartridge and the shot, powder and primer having been removed. As an alternative, the plastic portion may remain in the cartridge. A method of mounting a turkey beard on the display device includes the steps of removing the beard from the turkey carcass including a fleshy plug, treating the fleshy plug in a preservative, placing the fleshing:plug into the casing, inserting the barbed tip end or other engaging member through the primer pocket hole in the casing and impaling the barb in the fleshy plug, seating the flange in the hole, and drying the beard.

Accordingly, it is a principal object of the invention to provide a turkey beard display device having a ring or other fitting for hanging the display device from a hook in any desired location.

It is another object of the invention to provide a turkey beard display device which utilizes a portion of a shotgun shell as part of the display for its ornamental, symbolic, and functional value as a casing for the fleshy plug of the turkey beard.

It is a further object of the invention to provide a turkey beard display device which may display the turkey beard as a trophy independently of a plaque or, alternatively, in combination with a plaque.

Still another object of the invention is to provide a method for mounting a turkey beard as a trophy which does not require the use of adhesives or other chemical bonding agents.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
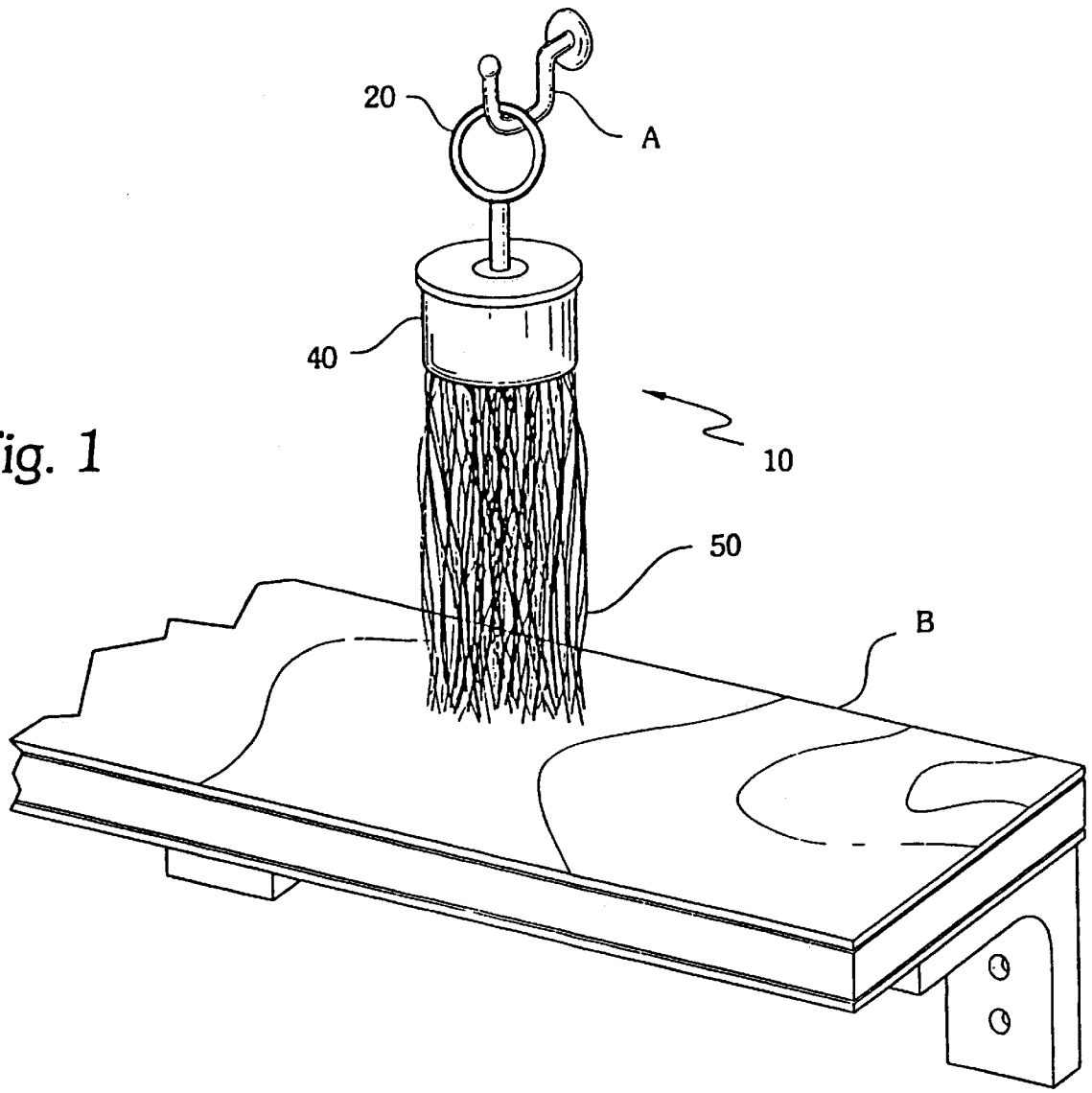
FIG. 1 is an environmental, perspective view of a turkey beard display device according to the present invention.
Figure 2:
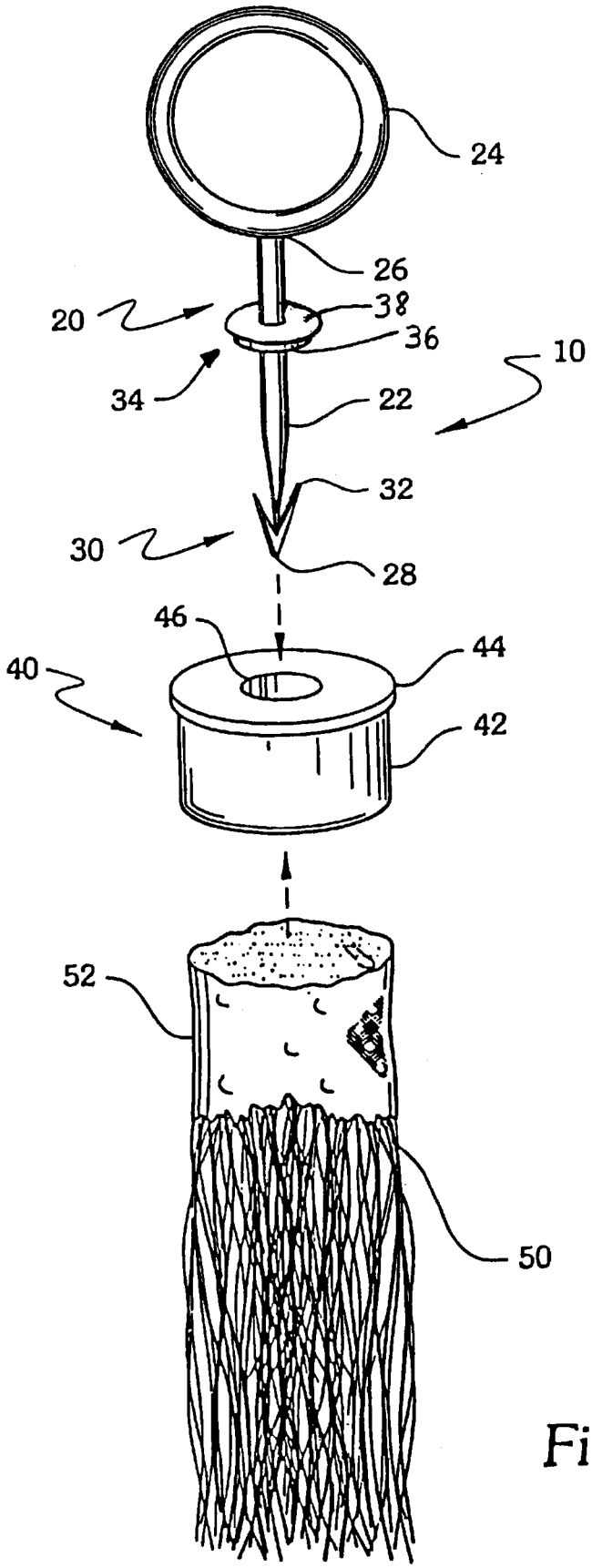
FIG. 2 is an exploded view of a turkey beard display device according to the present invention.

The present invention is a turkey beard display device, designated generally as 10 in the drawings. As shown in FIGS. 1 and 2, the device 10 includes a turkey beard retainer 20 and a casing 40. As shown more particularly in FIG. 2, the retainer 20 includes a shaft 22 having a ring or other fitting 24 at a first end 26 of the shaft 22 adapted for receiving a hook A on which the device 10 may be mounted for display above a mantelpiece B or other suitable location. Although the fitting 24 is shown as having a ring shape, it may have any desired size or shape, viz., U-shape, square, triangular, etc.

Figure 3:
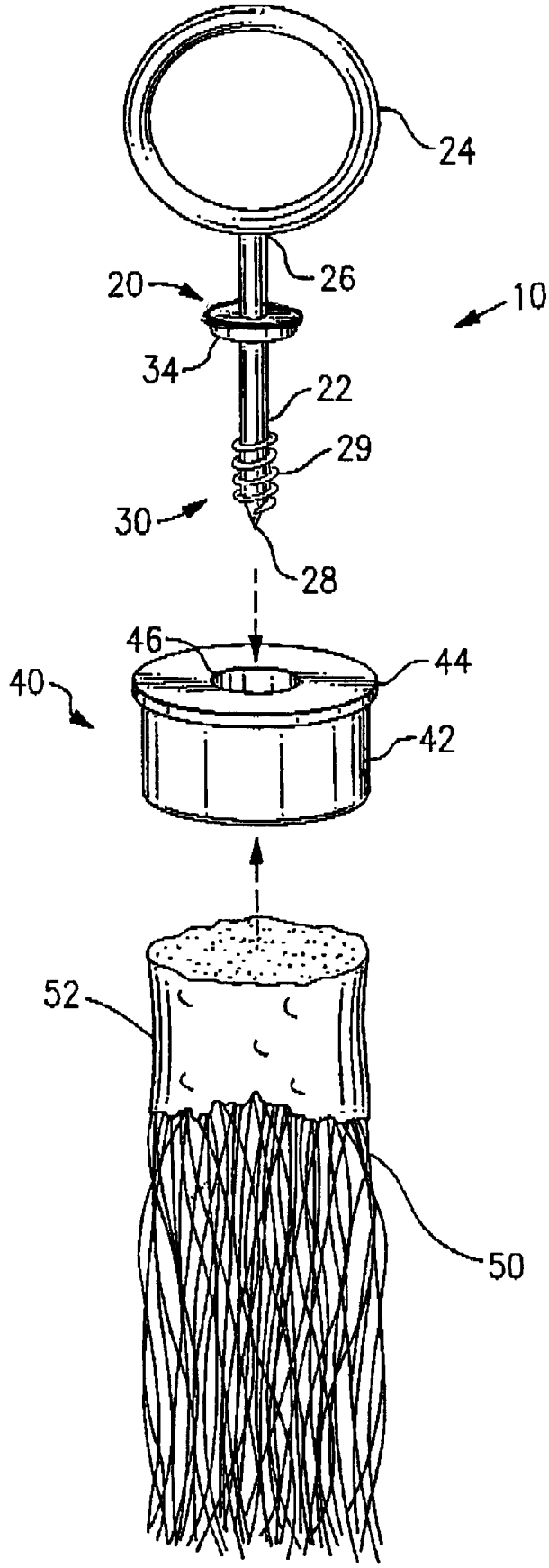
FIG. 3 is an exploded view of an alternate embodiment of the present invention.

The retainer 20 has a pointed tip 28 at the second end 30 of the shaft 22. The pointed tip end 28 has an engaging member in the form of a pair of barbs 32. The barbs 32 may be rigid or flexible. The flexible barbs 32 are flexible enough to be compressed, but are resilient in order to resume their shape after the compressive force is removed. As shown in FIG. 3, an alternate embodiment of the engaging member includes a set of screw threads 29. Although the engaging member has been disclosed in the form of barbs 32 or screw threads 29, other forms and shapes of engaging members may also be provided as known to those of ordinary skill in the art. In whatever form the engaging member takes, it must be capable of advancing through the fleshy plug during the mounting process and must be capable of providing an attachment surface for holding the dried plug.

A radial flange 34 extends transverse to the longitudinal axis of the shaft 22 between the first end 26 and the second end 30. The radial flange 34 includes a bottom portion 36 and a top portion 38. The top portion 38 has a larger radius than the bottom portion 36.

The casing 40 is preferably the hull of a shotgun shell, and may be the brass or brass plated steel portion of the shell used to kill the turkey. The casing 40 may be prepared by cutting the plastic or paper portion of the cartridge off the brass hull and then removing the primer. This leaves a hollow, cylindrical hull having a side wall 42 and a base wall 44 having a hole 46 defined therein, formerly occupied by the primer above the primer pocket. The casing 40 is preferably made from the hull of a 10, 12, 16, or 20 gauge shotgun shell. As an alternative, the plastic portion may remain in the spent cartridge.

While it is preferred that the casing 40 be made from the brass hull of a shotgun shell, both for its ornamental and symbolic value as a remembrance of the hunt, it will be obvious that the casing 40 may be specially made for mounting the beard from any desired metal, plastic, or other rigid material. The dimensions of the casing 40 may vary, depending upon the gauge and type of shell. Representative dimensions for a twelve gauge shotgun shall include: length of side wall 42 about 15–25 mm, diameter of base wall 44 about 21 mm, and diameter of hole 46 about 5 mm.

The turkey beard 50 is removed from the carcass together with a fleshy plug 52. The plug 52 is salted or treated with other preservatives, such as boric acid or Borax® (sodium borate). The plug 52 is inserted into the casing 40 and the pointed tip end 28 is inserted through the hole 46, the fleshy plug 52 being impaled by the barbs 32 and the bottom portion 36 of radial flange 34 seating in the hole 46. The turkey beard 50 is then allowed to dry. As the turkey beard 50 dries, the fleshy plug shrinks in and around the barbs 32 or other engaging member. The length of the shaft 22 between the flange 34 and the pointed tip end 28 should be less than the length of the side wall 42 so that there is no risk of being stabbed by the tip end 28 of the shaft 22 during assembly of the display device 10.

The turkey beard retainer 20 is preferably made from brass to correspond to the casing 40. The retainer 20 may, however, be made from steel or aluminum plated with brass, from plastic, or from any other rigid material.

A method of mounting a turkey beard 50 may include the following steps: removing the beard 50 from the turkey carcass, including a fleshy plug 52; treating the fleshy plug 52 in a preservative; placing the fleshy plug 52 into the casing 40; inserting the barbed tip end 28 of the retainer 20 through the primer pocket hole 46 in the casing 40; impaling the barb 32 or other engaging member in the fleshy plug 52; seating the bottom portion 36 of flange 34 in the hole 46; and drying the beard 50.

It is to be understood that the turkey beard display device 10 may be marketed in the form of the retainer 20 alone, in the form of a retainer 20 in combination with a casing 40 (the spent shotgun shell used in killing the turkey being used for the casing 40), or in the form of a kit including the retainer 20, casing 40, preservative, etc.

It is to be understood that the present invention is not limited to the sole embodiments described above, but encompasses any and all embodiments within the scope of the following claims.

What is claimed:

1. A turkey beard display devise, comprising a turkey beard retainer having:

a) a shaft having a first end and a second end;

b) a fitting for receiving a hook at the first end of said shaft;

c) a pointed tip end at the second end of the shaft;

d) at least one engaging member disposed on the shaft, wherein the engaging member comprises screw threads; and e) a flange disposed transverse to said shaft between the first end and the second end of said shaft.

2. A turkey beard display device, comprising a turkey beard retainer having:

a) a shaft having a first end and a second end;

b) a fitting for receiving a hook at the first end of said shaft;

c) a pointed tip end at the second end of the shaft;

d) at least one engaging member disposed on the shaft;

e) a flange disposed transverse to said shaft between the first end and the second end of said shaft;

f) a hollow casing having a base wall with a hole defined therein, the pointed tip end of said retainer being extendible through the hole defined in said base wall in order to impale a fleshy plug supporting a turkey beard.

3. The turkey beard display device according to claim 2, wherein said casing is made from a portion of a shotgun shell.

4. The turkey beard display device according to claim 2, wherein the casing is a cylindrical hull having a side wall.

5. The turkey beard display device according to claim 2, wherein the flange extending from the shaft of said turkey beard retainer is adapted for seating in the hole defined in the base wall of said casing when the pointed tip end of said retainer is inserted through the hole defined in the base wall of said casing in order to impale a fleshy plug supporting a turkey beard.

6. A turkey beard display device, comprising:

a) a shaft having a first end and a second end;

b) a fitting for receiving a hook at the first end of said shaft;

c) a pointed tip end at the second end of the shaft;

d) at least one engaging member disposed on the shaft; and e) a hollow casing having a base wall with an opening defined therein, the pointed tip end on the shaft capable of passing through the opening in order to impale a fleshy plug supporting a turkey beard.

7. A method of mounting a turkey beard on a turkey beard display device, comprising the steps of:

a) removing a turkey beard from a turkey carcass, including a fleshy plug;

b) treating the fleshy plug in a preservative;

c) placing the fleshy plug into a casing, the casing being hollow and having a side wall and a base wall with a hole defined therein;

d) inserting a barbed, pointed tip end of a turkey beard retainer having a fitting adapted for receiving a hook through the hole in the base wall of said casing;

e) impaling the barb, pointed tip end of said retainer in the fleshy plug of the turkey beard; and f) drying the turkey beard.

8. The method of mounting a turkey beard according to claim 7, further comprising the step of treating the fleshy plug of the turkey beard with salt.

9. The method of mounting a turkey beard according to claim 7, wherein the step of treating the fleshy plug in a preservative includes treating the fleshy plug in boric acid.

10. The method of mounting a turkey beard according to claim 7, wherein the step of treating the fleshy plug in a preservative includes treating the fleshy plug in sodium borate.

11. The method of mounting a turkey beard according to claim 7, further comprising the step of seating a flange extending from said retainer in the hole defined in the base wall of said casing.

* * * * *